United States Patent [19]

Hasebe et al.

[11] Patent Number: 4,476,779

[45] Date of Patent: Oct. 16, 1984

[54] COMPRESSION BUNDLING APPARATUS

[75] Inventors: Tsutomu Hasebe, Koganei; Teigo Takahashi, Kodaira, both of Japan

[73] Assignee: Tezuka Kosan Kabushiki Kaisha, Tokyo, Japan

[21] Appl. No.: 79,879

[22] Filed: Sep. 28, 1979

[30] Foreign Application Priority Data

Oct. 3, 1978 [JP] Japan ..... 53-135165[U]

[51] Int. Cl.[3] ..... B65B 13/00

[52] U.S. Cl. ..... 100/7; 100/3; 100/4; 100/14; 100/26; 100/218; 100/249

[58] Field of Search ..... 100/3, 7, 4, 26, 14, 100/249, 137, 218, 246, 247, 252, 253

[56] References Cited

U.S. PATENT DOCUMENTS

| | | | |
|---|---|---|---|
| 3,451,185 | 6/1969 | Tezuka | 100/3 X |
| 3,521,550 | 7/1970 | Van Doorn | 100/26 |
| 3,576,161 | 4/1971 | Wright | 100/3 |
| 3,895,572 | 7/1975 | Nitschke | 100/3 X |
| 3,929,062 | 12/1975 | Thompson | 100/218 X |
| 3,937,139 | 2/1976 | Lendi | 100/218 X |

*Primary Examiner*—Billy J. Wilhite
*Attorney, Agent, or Firm*—Gabriel P. Katona

[57] ABSTRACT

There is disclosed a compression bundling apparatus which can be used to compression pack or bundle such materials as waste paper, hair, cotton, plastics, crude rubber, city rubbish and the like. The apparatus can be used for lateral and vertical binding with polypropylene plastic bands. The apparatus has two main sections, the compression section and the bundling section. The two sections are connected by a guide space in which the compressed material is conveyed to the bundler where it is then bound by vertical and, if desired, lateral bands to form the bundle. There is means to discharge the banded bundle or to discharge the compressed bundle prior to banding. The vertical banding is accomplished by the cooperation of a plurality of band guides external to the compression chamber and movable into the bundling chamber which has a movable bundler for causing the bands to bind the compressed block into a bundle.

1 Claim, 6 Drawing Figures

COMPRESSION BUNDLING APPARATUS

BACKGROUND

The present invention relates to a compression bundling apparatus that compresses and bundles wastepaper, hair, cotton, plastics, crude rubber and city rubbish, etc.

Hitherto, various devices for compressing and wrapping and/or bundling materials with strong restoration such as wastepaper or the like have been proposed. However, these devices are such that they wrap and/or bundle, e.g. wastepaper, compactly compressed therein only after releasing the press on the wastepaper, causing the door thereon to open because of the expansion of the paper. For this reason, wastepaper at the door side expands outwardly. This is particularly true of wastepaper formed like a strip since it tends to expand forward or outward dangerously often resulting in unavoidable degeneration of the compression effects.

SUMMARY OF THE INVENTION

Accordingly, the object of the present invention is to provide a compression building apparatus that can automatically function in a series of continuous strokes for compression thru bundling of wastepaper, hair, cotton, plastics, crude rubber, city rubbish and the like and that can bundle such materials while they are being compressed.

BRIEF DESCRIPTION OF THE DRAWINGS

The invention is explained with reference to the drawings in which.

DETAILED DESCRIPTION OF THE INVENTION

Figure 1:
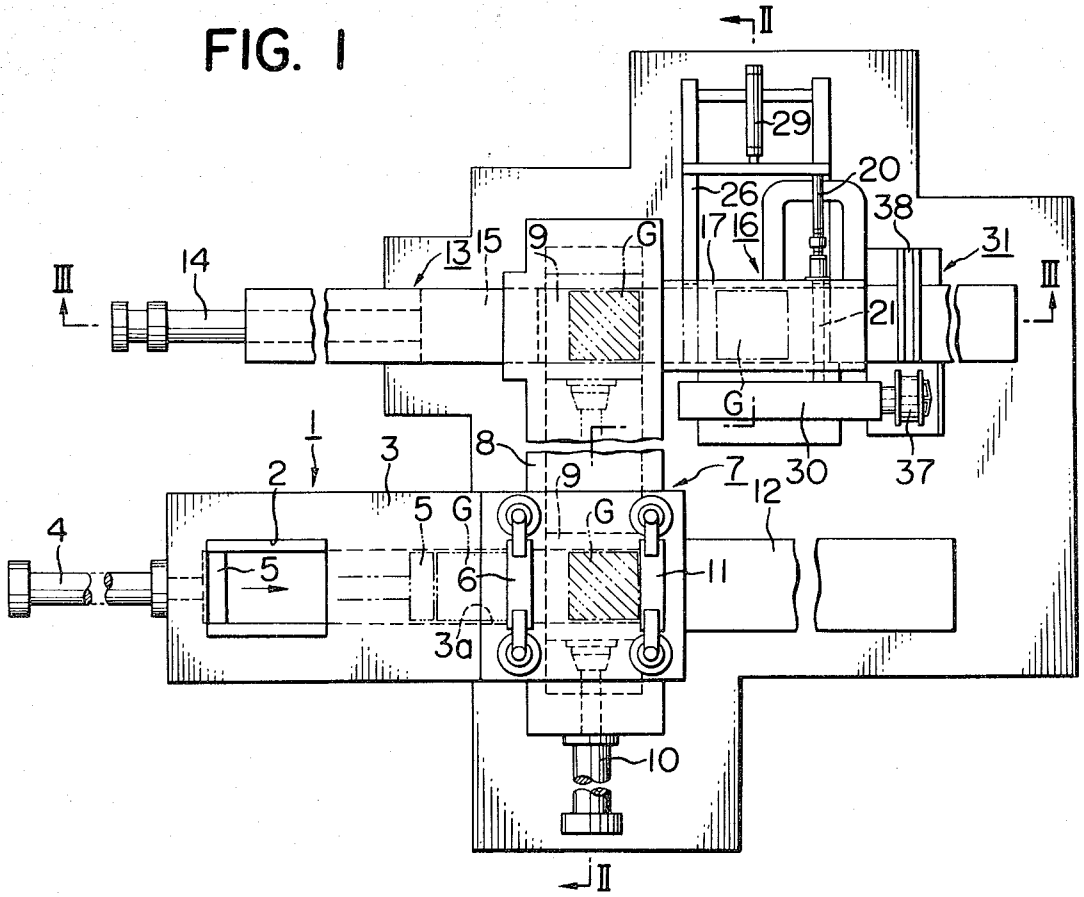
FIG. 1 is partial-notched plan view of the bundling apparatus of this invention.
Figure 2:
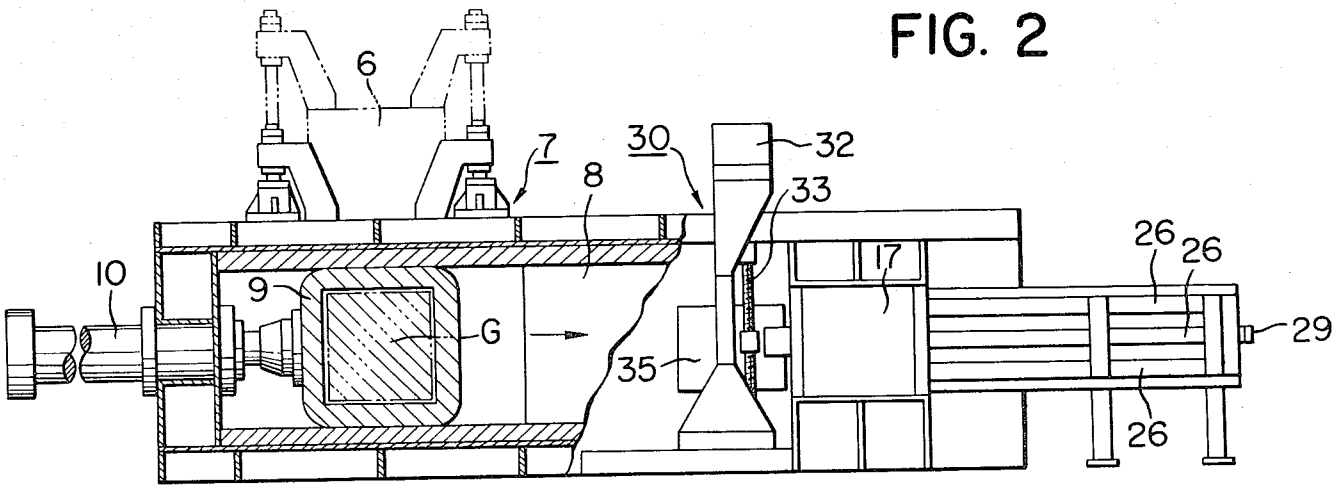
FIG. 2 is a section taken along line II—II of FIG. 1.

In FIG. 1, compression device 1 is composed of compression space 3 having hopper 2 into which the material to be compressed is placed, and compression plates 5 which reciprocates within the compression space 3 by action of an oil hydraulic cylinder 4. On the side opposite to the compression plate 5 is provided a movable wall 6 that slides in vertical directions for closing or opening the outlet 3*a* of the compression space 3. Adjacent to the compression device 1, as shown in FIGS. 1 and 2, is provided conveyor 7 that conveys the compressed block G. The conveyor 7 is equipped with a guide space 8 in a direction directly intersecting the compression space 3. In the guide space 8, a cylinder-like container 9 with both its ends open directly connects with the ram end of cylinder 10. In this manner the container 9 is able to reciprocate within the guide space 8 through the operation of the cylinder 10. The container 9 is of such an inner shape that can be continuous to the outlet 3*a* of the compression space 3. In addition, the side wall of guide space 8 facing toward a movable wall 6 is provided with a slide wall 11, and on its outside is provided a conveying passage 12 that allows the compressed block G to discharge when it is not necessary to bundle it.

Figure 3:
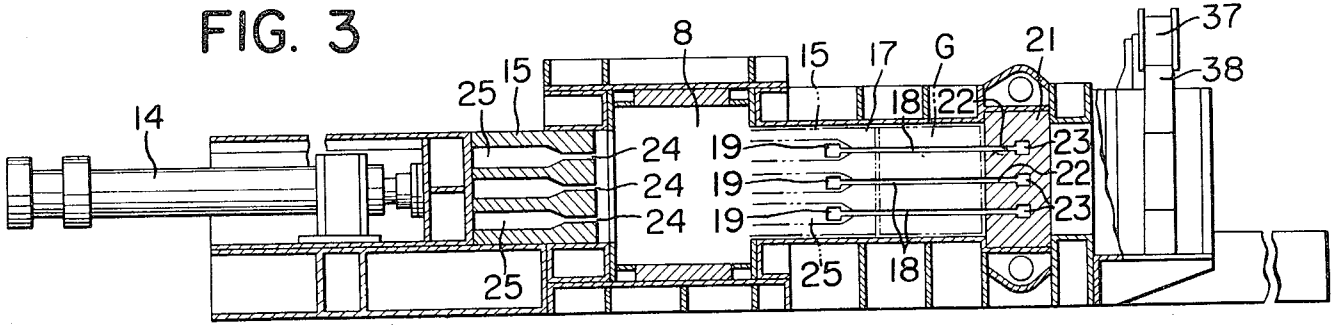
FIG. 3 is a section taken along line III—III of FIG. 1.
Figure 4:
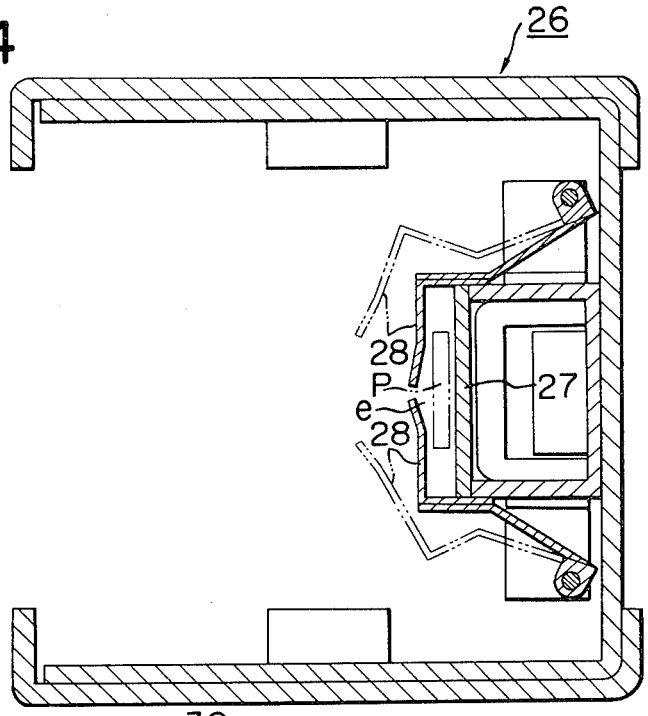
FIG. 4 is an enlarged section of band-passing guides.
Figure 5:
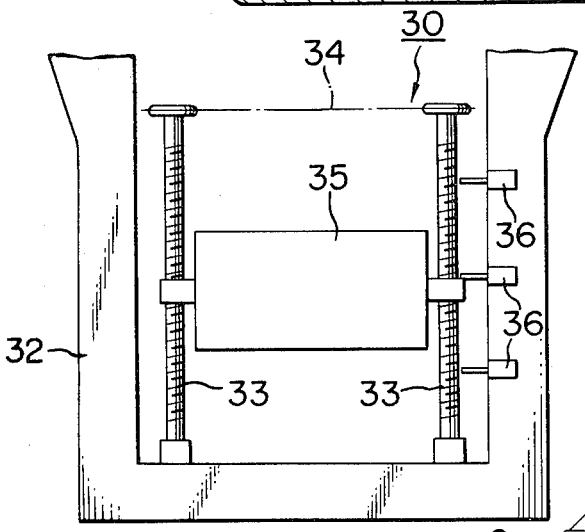
FIG. 5 is a front view of the bundling means.

Forward of the guide space 8, an extruding means 13 is provided in a direction directly intersecting it. The term "extrude" or its variations "extruded" and "extruding" as used herein means to push the material out and not to further shape it. The extruding means 13 consists of a push plate 15 which is activated by the operation of an oil hydraulic cylinder 14. The push plate 15 can extrude the compressed block G within container 9 into the bundling device 16. As shown in FIGS. 1–3, the bundling space 17 of the bundling device 16 directly intersects and leads to a guide space 8. As can be seen in FIG. 3, both sides of the wall of the bundling space 17 are bored with several parallel slots 18, and on the wall at the end are also bored guide passages 19 larger in size than the parallel slots 18. As shown in FIGS. 1 and 3, on the opposite side of the push plate 15 within the bundling space 17 there is located a movable door 21 for closing or opening by means of a cylinder 20. The movable door is provided with bored slots 22 corresponding with said parallel slots 18 on its inner wall, and behind them are bored guide passages 23 which are larger than the parallel slots 18. Moreover, on the inside wall of the push plate 15 for reciprocation within bundling space 17 there are bored slots 24 corresponding with the slots 18 of bundling space 17, and behind them are also bored guide passages 25 larger in size than the slots 24 and corresponding with guide passages 19. Toward the back of the bundling space 17 are located a plural number of band passing guides 26 formed in the shape of the letter U for corresponding with the guide passages 19 and 23. The respective band passing guides 26 are positioned both their ends being slightly inserted in guide passages 19 and 23. As shown in FIG. 4, respective band passing guide 26 is U-shape when viewed in section, within which there are provided a guide plate 27 and opening plates 28 which open forward on both sides. Binding wire, for example, polyproprene plastic band (referred to as PP band hereunder) is then placed into clearance e between the guide plate 27 and the opening plates 28. And, the leg portions on both ends of the respective passing guides 26 are made to plunge into the bundling space 17 and further advance by the operation of the cylinder 29 until they come in contact with the guide passages 19 and 23 on the front wall part of the bundling space 17. On the opposite side of the band passing guide 26 beyond the bundling space 17 is provided a bundler 30 located between them. The bundler 30 is provided, as shown in FIG. 5, with two screw rods 33 at both ends vertically mounted on the frame 32 so that they can rotate, and the two screw rods 33 perform an interlock operation through the chain 34 by means of motor (not shown). Across the two screw rods 33 is fitted the bundler body 35, and a plural number of limit switches 36 are located at a given interval near near one of the screw rods 33. Accordingly, the bundler body 35 moves in a vertical direction along the screw rods 33 as corresponds to the rotation by screw rods 33. After the bundler 35 gradually comes in contact with the respective limit switches 36, the compressed block G is laterally bound with several lines of the PP bands P.

On the right side of the lateral binding bundler 16 is provided a vertical binding bundler 31 adjacent thereto. The compressed block G moves its position in turn by the pressing of push plate 15 and is bundled and packed up in a vertical direction by means of a bundler 37 and a guide frame 38.

Figure 6:
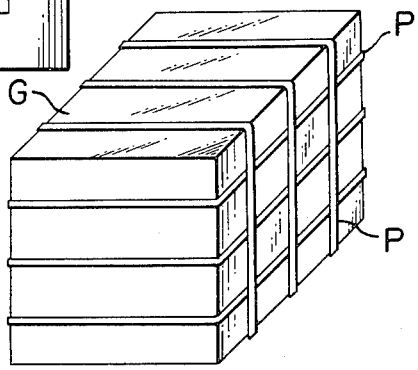
FIG. 6 is a perspective view of the compressed block made by the apparatus of this invention.

The following is an explanation of how the compression packing apparatus operates. The matter to be compressed such as wastepaper is placed into the compression space 3 through a hopper 2 and is then compressed by the compression plate 5 that advances by the operation of the cylinder 4 and comes to be a compressed block G in the compression space 3. After compression, which makes the movable wall 6 open and causes compression plate 5 to move forward allowing the compressed block G to be received within the container 9 which is ready for service in the guide space 8. The container 9 is then conveyed to the point of the guide space 8 by the operation of the cylinder 10. Successively, the compressed block G within the container 9 is extruded and received within the bundling space 17 by the push plate 15 that advances by operation of the cylinder 14 (shown by the broken line in FIG. 3). When the band passing guide 26 is made to advance through operation of the cylinder 29, one leg part is inserted within one of the guide passages 23 in the movable door 21 and another leg part is inserted into the guide passage 25 of the push plate 15 by way of one of the guide passages 19 in the bundling space 17. Then the bundler 30 starts and the PP band P delivers passes energetically through clearance e between the guide plates 27 and the opening plates 28 within the respective band passing guides 26, and its tip end returns to the bundler 30. The PP band P is tightened by means of the bundler 30 and and it comes out pushing open the opening plate 28 of the band passing guide 26,, and further passes through the slots 19 and 22 of the bundling space 17 and the slot 24 of the push plate 15. The PP band P ther is bound and tied up laterally around compressed block G. Finally, the bundler 30 welds the lapped layers of the PP bands P. It then cuts across subsequent lateral PP bands P, thereby completing bundling of the compressed block G by lateral binding. Lateral binding at appropriate spacing is performed by moving the bundler body 35 vertically (See FIG. 6).

After completion of bundling as described above, the band passing guide 26 is made to move back, and the push plate 15 is caused to advance concurrently with opening of the movable door 21 by operation of the cylinder 20. Thus the compressed block G is delivered to the vertical binding bundler device 31. In the bundler device 31, the compressed block G is first bound vertically with a single PP band P by means of a binder 37 and then further moved forward by the push plate 15. Vertical binding is thus accomplished at appropriate spacing with the PP bands P, thereby completing the bundling and packing of the compressed block G (See FIG. 6).

After packing of the compressed block G, it is pushed out to its required position by the push plate 15. The push plate 15 is then made to move back to its starting position. Also, the container 9 is caused to move back to be situated behind the movable wall 6 for preparation of packing the next compressed block.

The packing apparatus devised herein will not always pack up the compressed block both vertically and laterally. Where vertical binding packing is not required, dependent upon the kind or type of the compressed matter, the vertical bundler binding device 31 may be kept inoperative.

We claim:

1. A compression bundling apparatus comprising:

a compression means, a bundling means and a conveyor means connecting said compression means and said bundling means;

said compression means comprising a compression device having a movable compression plate for compressing compressible material into a compressed block in a compression space therein;

said conveyor means having therein a reciprocating container for receiving said compressed block from said compression device and being within a guide space therein, which guide space directly intersects an outlet of said compression space and an inlet of said bundling means, said container adapted to be moved along said guide space from said compression space outlet to said inlet of said bundling means and to be returned when empty;

said bundling means comprising an extruding means and a band binding means at a bundling space in said bundling means wherein said extruding means comprises a cylinder and a push plate, said cylinder adapted to push said push plate against said compressed block in said container to extrude said block into said bundling space in said band bundling means, said bundling space having a wall portion and a movable door on the side opposite said push plate, said wall portion, movable door and push plate each have a plurality of matching slots for receiving binding band guides which range through the bundling space and serve as passages for said bands, after said compressed block is extruded into said bundling space; and a bundler adapted for moving in a vertical direction in relation to said compressed block to guide and move the binding bands through said bundling space by degrees to vertically bind said compressed block into a bundle.

* * * * *